US005474697A

United States Patent [19]

Sasaki et al.

[11] Patent Number: 5,474,697

[45] Date of Patent: Dec. 12, 1995

[54] ELECTRORHEOLOGICAL FLUID CONTAINING CARBONACEOUS PARTICLES

[75] Inventors: Makoto Sasaki; Hisatake Sato; Osamu Kato, all of Yokohama, Japan

[73] Assignee: Nippon Oil Company, Ltd, Tokyo, Japan

[21] Appl. No.: 267,302

[22] Filed: Jun. 29, 1994

Related U.S. Application Data

[63] Continuation of Ser. No. 994,729, Dec. 22, 1992, abandoned.

[30] Foreign Application Priority Data

Dec. 27, 1991 [JP] Japan ..... 3-358257
Jan. 10, 1992 [JP] Japan ..... 4-020654

[51] Int. Cl.[6] ..... C10M 171/00; C10M 169/04

[52] U.S. Cl. ..... 252/73; 252/572

[58] Field of Search ..... 252/73, 572

[56] References Cited

U.S. PATENT DOCUMENTS 3,047,507 7/1962 Winslow ..... 252/75

FOREIGN PATENT DOCUMENTS

| | | |
|---|---|---|
| 0201213 | 11/1986 | European Pat. Off. . |
| 0394049 | 10/1990 | European Pat. Off. . |
| 0406853 | 1/1991 | European Pat. Off. . |
| 51-33783 | 3/1976 | Japan . |
| 53-93186 | 8/1978 | Japan . |
| 58-179259 | 10/1983 | Japan . |
| 61-44998 | 3/1986 | Japan . |
| 62-95397 | 5/1987 | Japan . |
| 3-47896 | 2/1991 | Japan . |
| 1076754 | 7/1967 | United Kingdom . |

*Primary Examiner*—Christine Skane
*Attorney, Agent, or Firm*—Armstrong, Westerman, Hattori, McLeland & Naughton

[57] ABSTRACT

An electrorheological fluid comprising an electrically insulating liquid and oxidation-treated carbonaceous particles dispersed therein and an electrorheological fluid comprising an electrically insulating liquid and a carbonaceous particles having a shape anisotropy, 0.02 to 10,000 μm in length, 0.01 to 500 μm in diameter and 2 to 1,000,000 in aspect ratio have a high electrorheological effect, less current passage and no short circuit, though it is a water-free system.

2 Claims, 1 Drawing Sheet

50 μm

50 μm

50 μm

ELECTRORHEOLOGICAL FLUID CONTAINING CARBONACEOUS PARTICLES

This application is a continuation of application Ser. No. 07/994,729 filed Dec. 22, 1992, now abandoned.

BACKGROUND OF THE INVENTION

1) Field of the Invention

The present invention relates to a water-free, electrorheological fluid capable of controlling the viscosity by application of an electric field.

2) Prior Art

An electrorheological fluid is a suspension comprising an electrically insulating liquid and inorganic or polymeric particles dispersed therein, whose viscosity is rapidly and reversibly changed by applying an electric field to the fluid, for example, from a liquid state to a plastic state or a solid state and vice versa. This phenomenon is called Winslows' effect.

Generally, particles whose surfaces can be readily polarized by application of an electric field are used as dispersible particles. As inorganic dispersible particles, silica is disclosed in U.S. Pat. No. 3,047,507; British Patent No. 1,076,754; and Japanese Patent Application Kokai (Laid-open) No. 61-44998, and zeolite is disclosed in Japanese Patent Application Kokai (Laid-open) No. 62-95397. As polymeric dispersible particles, alginic acid, carboxyl-containing glucose and sulfone-containing glucose are disclosed in Japanese Patent Application Kokai (Laid-open) No. 51-33783; divinylbenzene-cross-linked polyacrylic acid is disclosed in Japanese Patent Application Kokai (Laid-open) No. 53-93186; and resol-type phenol resin is disclosed in Japanese Patent Application Kokai (Laid-open) No. 58-179259.

Mineral oil, silicone oil, fluorocarbon oil, halogenated oil, etc. are known as an electrically insulating oil.

In the above-mentioned prior art it is necessary that water is adsorbed on the surfaces of dispersed particles to enhance the electrorheological effect, and thus a small amount of water is contained in the electrorheological fluid.

Mechanism of increasing the viscosity of an electrorheological fluid by application of an electric field thereto can be clarified according to the electrical double layer theory. That is, an electrical double layer is formed on the surfaces each of dispersed particles in an electrorheological fluid, and when no electric field is applied to the electrorheological fluid, the particles are repelled from one another on their surfaces and are never brought into an alignment of dispersed particles. When an electric field is applied thereto, an electrical deviation takes place on the electrical double layers of the dispersed particles, and the dispersed particles are aligned by an electrostatic attractive force to form a bridge of dispersed particles. Thus, the viscosity of the fluid is increased, sometimes resulting in solidification. The water contained in the electrorheological fluid promotes to form the electrical double layers.

A water-free electrorheological fluid based on fine carbon powder is disclosed in Japanese Patent Application Kokai (Laid-open) 3-47896.

The electrorheological fluid is expected to be used in engine mounts, shock absorbers, clutch, etc.

In the prior art, the presence of water is required for obtaining a satisfactory electrorheological effect, and thus there are still some problems due to the presence of water. One of the problems is a short circuit due to the easy current passage at an elevated voltage. Another problem is a limited applicable temperature range due to the reduced electrorheological effect by solidification of water into ice at 0° C. or lower, or by evaporation of water at 100° C. or higher. These problems have been main factors of preventing practical application of the electrorheological fluid.

The water-free electrorheological fluid based on fine carbon powder so far disclosed has a low electrorheological effect, because the fine carbon powder so far used is only the heat-treated one.

SUMMARY OF THE INVENTION

An object of the present invention is to provide a water-free electrorheological fluid having a high electrorheological effect and a less current passage, i.e. no possibility for a short circuit, in spite of the water-free system.

As a result of extensive studies, the present inventors have found a solution of the problems by using oxidation-treated carbonaceous particles as dispersible particles or carbonaceous particles having a shape anisotropy as a dispersible substance, and have established the present invention.

That is, according to a first aspect of the present invention, there is provided an electrorheological fluid, which comprises an electrically insulating liquid and oxidation-treated carbonaceous particles dispersed in the liquid.

According to a second aspect of the present invention there is provided an electrorheological fluid, which comprises an electrically insulating liquid and carbonaceous particles having a shape anisotropy of 0.02 to 10,000 μm in length, 0.01 to 500 μm in diameter and 2 to 1,000,000 in aspect ratio, dispersed in the liquid.

DETAILED DESCRIPTION OF THE INVENTION

Figure 1:
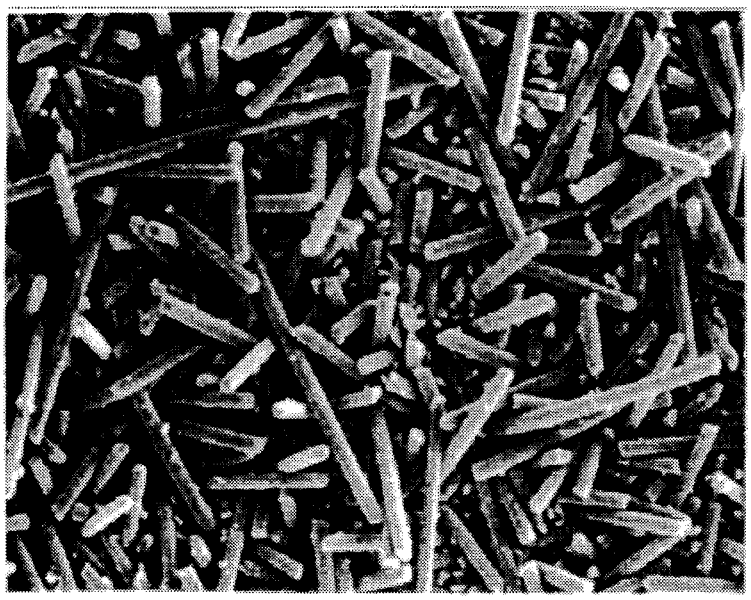
FIG. 1 is an electron microscope picture of carbonaceous particles having a shape anisotropy according to Example 4 of the present invention.

Dispersible carbonaceous particles for use in the present invention include, for example, various carbonblacks; finely pulverized coals such as anthracite, bituminous coal, etc.; finely pulverized petroleum pitches obtained by heat treatment of petroleum heavy oils such as naphtha residue, asphalt, fluidized catalytic cracking residue oil, etc.; finely pulverized coal pitches obtained by heat treatment of coal heavy oils such as coal tar, etc.; finely pulverized carbides of paraffins, olefins, etc. having 15 to about 20 carbon atoms; finely pulverized carbides of low molecular weight aromatic compounds such as naphthalene, biphenyl, etc.; finely pulverized carbides of polymers obtained by carbonizing polymers such as polyethylene, polymethylacrylate, polyvinyl chloride, phenol resin, polyacrylonitrile, etc., and also include mesophase microspheres obtained by mesophase (liquid crystal) conversion of petroleum pitches, coal pitches, carbides of polyvinyl chloride, etc. or particles containing the mesophase microspheres. Mesophase microspheres can be isolated as insoluble in a solvent such as quinoline, etc. In the first aspect of the present invention, dispersible carbonaceous particles obtained from petroleum pitches or coal pitches can be preferably used.

In the second aspect of the present invention, petroleum pitches, coal pitches, carbides of polyacrylonitrile, etc., which can be readily made into fibers, are preferable as carbonaceous particles, and particularly petroleum pitches and coal pitches are preferable.

In the first aspect of the present invention, dispersible carbonaceous particles can be oxidized according to well known oxidation procedures. For example, the dispersible carbonaceous particles can be slowly oxidized with an oxidizing gas such as oxygen, ozone, air, nitrogen oxides, halogen, sulfur dioxide gas, etc. in a gas phase or in a liquid phase using a hydrocarbon solvent at a temperature of 20° to 400° C., preferably 20° to 350° C. usually for 0.1 minute to 5 hours. The oxidation-treated dispersible carbonaceous particles of the first aspect of the present invention has an oxygen concentration of 0.3% by weight or more, preferably 0.5 to 25% by weight, and an oxygen concentration on the particle surface being at least 1.3 times, preferably 1.5 to 80 times, that in the particle interior. Below 0.3% by weight, a high electrorheological effect is hard to obtain, whereas above 25% by weight the current is easy to pass, resulting in a risk of short circuit. When the oxygen concentration on the particle surface is less than 1.3 times that in the particle interior, a high electrorheological effect is hard to obtain, whereas when it exceeds 80 times a stable electrorheological effect is hard to obtain.

The particle surface refers to a region down to a depth corresponding to 10% of the particle radius from the outer surface of the particle, and the particle interior refers to the other region than the particle surface. In the present invention, the oxidation-treated dispersible carbonaceous particles can be further fired in an inert gas at 100° to 800° C.

It seems that the reason why the electrorheological effect can be increased by the oxidation treatment is that the radical concentration on the carbonaceous particle surface is increased by the oxidation and polarization on the surface being promoted in an electric field thereby.

The surface-oxidized dispersible carbonaceous particles have a particle size of 0.01 to 500 μm, preferably 1.0 to 100 μm. Below 0.01 μm, no sufficient electrorheological effect is obtained, whereas above 500 μm no satisfactory dispersion stability is obtained (according to a standing sedimentation test for several hours).

In the first aspect of the present invention, a ratio of the dispersible particles to the electrically insulating liquid in the electrorheological fluid is preferably 1 to 60:99 to 40% by weight, particularly preferably 5 to 50:95 to 50% by weight. Below 1% by weight of the dispersible particles no satisfactory electrorheological effect is obtained, whereas above 60% by weight of the dispersible particles, the initial viscosity is considerably large without application of an electrical field and this is not practically preferable.

In the second aspect of the present invention, the carbonaceous particles having a shape anisotropy refers to carbonaceous particles having a rod-like or whisker-like shape, 0.02 to 10,000 μm, preferably 10 to 5,000 μm in length, 0.01 to 500 μm, preferably 1.0 to 100 μm in diameter and 2 to 1,000,000, preferably 2 to 100,000, more preferably 3 to 10,000 in aspect ratio. When the carbonaceous particles having a shape anisotropy have a diameter of less than 0.01 μm, no sufficient electrorheological effect is obtained, whereas when it has a diameter of more than 500 μm, no satisfactory dispersion stability is obtained (according to a standing sedimentation test for several hours). When the carbonaceous particles having a shape anisotropy have a length of less than 0.02 μm, no sufficient electrorheological effect is obtained, whereas when it has a length of more than 10,000 μm, no satisfactory dispersion stability is obtained. When the carbonaceous particles having a shape anisotropy have an aspect ratio of less than 2, no sufficient electrorheological effect is obtained, whereas when it has an aspect ratio of more than 1,000,000, the initial viscosity is considerably large without application of an electrical field. This is not practically preferable.

The carbonaceous particles can be provided with a shape anisotropy in several manners, for example, by spinning the carbonaceous particles into fibers by well known dry or wet spinning process or melt spinning process and pulverizing the resulting fibers in a mixer, for example, Henschel mixer or the like. Whisker-shaped carbonaceous particles can be obtained by subjecting hydrocarbons having 1 to 9 carbon atoms to gas phase pyrolysis in hydrogen in the presence of a metallic catalyst.

Furthermore, in the second aspect of the present invention, an oxidation-treated carbonaceous particle having a shape anisotropy can be also used to increase the electrorheological effect. The carbonaceous particles can be oxidized by the same well known procedure as used in the first aspect of the present invention.

The oxidation treatment can be carried out in the state of fibers obtained by spinning the carbonaceous particles or after the pulverization of the fibers. The oxidation treatment of pulverized product has a risk of dust explosion and thus it is preferable to carry out the oxidation treatment in the fibrous state.

The oxidation-treated carbonaceous particles having a shape anisotropy according to the second aspect of the present invention have an oxygen concentration of 0.3% by weight or more, preferably 0.5 to 25% by weight, and an oxygen concentration on the surface of the carbonaceous particles being at least 1.3 times, preferably 1.5 to 80 times, that in the interior of the carbonaceous particles. When the oxygen concentration of the carbonaceous particles is less than 0.3% by weight, a high electrorheological effect is hard to obtain, whereas when it exceeds 25% by weight, the current is easy to pass, resulting in a risk of short circuit. When the oxygen concentration on the surface of the carbonaceous particles is less than 1.3 times that in the interior of the carbonaceous particles, a high electrorheological effect is hard to obtain, whereas it exceeds 80 times, a stable electrorheological effect is hard to obtain.

The surface of the carbonaceous particles refers to a region down to a depth corresponding to 10% of the radius of particle from the outer surface of the particles, and the interior of the carbonaceous particles refers to the other region than the surface of the carbonaceous particles.

After the oxidation treatment, the carbonaceous particles can be further fired in an inert gas at 100° to 800° C.

It seems that the reason why the electrorheological effect is increased by using carbonaceous particles having a shape anisotropy is that an aligned structure can be more readily obtained than spherical or block-shaped particles, and that why the electrorheological effect is more increased by the oxidation treatment is that the radical concentration on the surfaces of the carbonaceous particles is increased by the oxidation treatment and polarization can be promoted in an electrical field thereby.

In the second aspect of the present invention, pulverized carbonaceous fibers obtained by spinning into fibers and successive pulverization are preferably used as carbonaceous particles having a shape anisotropy, and oxidation-treated, pulverized carbonaceous fibers are more preferably used.

In the second aspect of the present invention, pulverized fibers of petroleum pitch or coal pitch are preferably used as carbonaceous particles having a shape anisotropy, and oxidation-treated, pulverized fibers of petroleum or coal pitch are more preferably used.

In the second aspect of the present invention, a ratio of the carbonaceous particles having a shape anisotropy to the electrically insulating liquid in an electrorheological fluid is 1 to 60:90 to 40% by weight, preferably 5 to 50:95:50% by weight. When the carbonaceous particles having a shape anisotropy are less than 1% by weight, no sufficient electrorheological effect is obtained, whereas when it exceeds 60% by weight, the initial viscosity is considerably large without application of an electrical field. This is not practically preferable.

The electrically insulating liquid for use in the present invention includes hydrocarbon solvents such as mineral oil, alkylnaphthalene, poly α-olefin, etc.; ester oils such as butyl phthalate, butyl sebatate, etc.; ether oils such as oligophenylene oxide, etc., silicone oils, fluorocarbon oils, etc. The electrically insulating oil preferably has a viscosity of 0.5 to 500 cSt at 25° C.

Other dispersible particles, a dispersant such as a surfactant, etc. can be added to the present electrorheological fluid as additives in such a range as not to deteriorate the electrorheological effect of the present electrorheological fluid.

The present electrorheological fluid can show a distinguished electrorheological effect in a water-free system, and can be used in the fields of engine mounts, shock absorbers, clutches, torque converters, brake systems, power steering, valves, dampers, actuators, vibrators, etc.

PREFERRED EMBODIMENTS OF THE INVENTION

The present invention will be described in detail below, referring to Examples, which show embodiments of the present invention and are not limitative of the present invention.

Example 1

Heavy oil having a boiling point of 320°–550° C., obtained by fluidized catalytic cracking of desulfurized vacuum gas oil of Arabian origin at 500° C. with a silica-alumina-based catalyst was subjected to heat treatment at a temperature of 430° C. under a pressure of 15 kg f/cm.G for 3 hours. The heat-treated oil was distilled at 250°/1 mmHg to remove light fractions, whereby a pitch (1-I) having a softening point of 98° C. was obtained.

Then, the pitch (1-I) was subjected to heat treatment in a nitrogen gas atmosphere at a temperature of 400° C. for 12 hours, whereby a pitch (1-II) having a softening point of 268° C. was obtained.

Then, the pitch (1-II) was finely pulverized to obtain pitch particles (1-1).

The pitch particles (1-1) were found by elemental analysis to have a carbon content of 95% by weight and a hydrogen content of 5% by weight. Spin concentration was found by ESR to be $4.0\times10^{19}$ spins/g.

Then, the pitch particles (1-1) were heated in air at a temperature elevation rate of 0.5° C./min up to 280° C. and subjected to heat treatment at 280° C. for one hour, whereby pitch particles (1-2) having an average particle size of 25 μm were obtained.

The pitch particles (1-2) were found by elemental analysis to have a carbon content of 78% by weight, a hydrogen content of 3% by weight, and an oxygen content of 19% by weight, and the spin concentration determined by ESR was $8.1\times10^{19}$ spins/g. The oxygen concentration on the particle surface determined by X-ray microanalysis (EPMA) was 4.5 times that in the particle interior.

10 g of the pitch particles (1-2) were dispersed in 40 g of silicone oil KF-96 (trademark of a product made by Shinetsu Silicone Co., Ltd., Japan) having a viscosity of 10 cSt to prepare an electrorheological fluid (1). Then, the electrorheological fluid (1) was passed from a dropping funnel into a high voltage cell, 16 mm long, 26 mm wide and 1 mm thick, provided with an inlet tube and an outlet tube, each 4 mm in inner diameter, while gradually increasing the applied voltage to determine the voltage at which no more electrorheological fluid (1) passed therethrough at constant 25° C. The electrorheological fluid (1) lost the flowability at 800 V and failed to pass therethrough. In that case, the lower the voltage at which no more fluid can pass therethrough, the better the electrorheological effect. The current at 2 kV was found to be 2.8 μA.

Example 2

Coal pitch was heat treated in a nitrogen gas atmosphere at 450° C. to obtain pitch (2-I) containing mesophase microspheres. Then, pitch particles (2-1) composed of mesophase microspheres were recovered from the pitch (2-I) by quinoline extraction.

The pitch (2-1) was found by elemental analysis to have a carbon content of 96% by weight, a hydrogen content of 3% by weight, and a nitrogen content of 1% by weight. The spin concentration determined by ESR was $6.1\times10^{19}$ spins/g.

The pitch (2-1) was surface-oxidized in the same conditions as in Example 1, whereby pitches particles (2-2) having an average particle size of 20 μm were obtained.

The pitch (2-2) was found by elemental analysis to have a carbon content of 80% by weight, a hydrogen content 3% by weight, nitrogen content of 1% by weight and oxygen content of 16% by weight. The spin concentration determined by ESR was $8.9\times10^{19}$ spins/g.

The oxygen concentration on the particle surface determined by EPMA was 4 times that in the particle interior.

Then, an electrorheological fluid (2) was prepared in the same manner as in Example 1 to determine the electrorheological effect. It was found that no more fluid passed through the high voltage cell at 750 V. The current at 2 kV was found to be 3.0 μA.

Example 3

10 g of the pitch particles (1-2) obtained in Example 1 were dispersed in 40 g of silicone oil kF-96 (trademark of a product made by Shinetsu Silicone Co. Ltd., Japan) having a viscosity of 10 cSt, and 0.2 g of polybutenyl succinimide was added thereto as a dispersant to prepare an electrorheological fluid (3).

Then, the electrorheological effect was determined in the same manner as in Example 1. It was found that no more fluid passed through the high voltage cell at 750 V. The current at 2 kV was found to be 3.6 μA.

Comparative Example 1

An electrorheological fluid (4) was prepared from the pitch particles (1-1) obtained in Example 1 in the same manner as in Example 1 without the oxidation treatment, and the electrorheological effect was determined. It was found that no more fluid passed through the high voltage cell at 2.5 kV, and the current at 2 kV was 2.2 μA.

Comparative Example 2

10 g of silica particles having a particle size of 15 μm were dispersed in 40 g of silicone oil kF-96 (trademark of a product made by Shinetsu Silicone Co. Ltd., Japan) having a viscosity of 10 cSt, and 1 g of water was added thereto to prepare an electrorheological fluid (5). Then, the electrorheological effect was determined in the same manner as in Example 1. It was found that no more fluid passed through the high voltage cell at 1.5 kV and when the voltage was elevated to 2 kV, a current of 21 μA was passed to cause a short circuit.

Example 4

Heavy oil having a boiling point of 320° to 550° C., obtained by fluidized catalytic cracking of desulfurized vacuum light oil of Arabian origin at 500° C. with a silica-alumina-based catalyst was subjected to heat treatment at a temperature of 430° C. under a pressure of 15 kg f/cm.G for 3 hours. The heat-treated oil was distilled at 250° C./1 mmHg to remove light fractions, whereby pitch (3-I) having a softening point of 98° C. was obtained.

Then, the pitch (3-I) was subjected to heat treatment at a temperature of 400° C. for 12 hours, while passing a nitrogen gas therethrough, whereby pitch (3-II) having a softening point of 268° C. was obtained. Then, the pitch (3-II) was spun into fibers, 15 μm at 315° C. through a spinner, 3 mm in nozzle diameter with L/D=2, and then the fibers were pulverized in a Henschel mixer for 3 seconds to obtain pitch (3-1) having a shape anisotropy. Electron microscope picture of pitch (3-1) is shown in FIG. 1. The pitch (3-1) had a rod-like shape in an aspect ratio of 3 to 50:1.

It was found by elemental analysis that the pitch (3-1) having a shape anisotropy had a carbon content of 95% by weight and a hydrogen content of 5% by weight. The spin concentration determined by ESR was $3.9\times10^{19}$ spins/g.

10 g of the pitch particles (3-1) were dispersed in 40 g of silicone oil kF-96 (trademark of a product made by Shinetsu Silicone Co., Ltd., Japan) having a viscosity of 10 cSt to prepare an electrorheological fluid (6).

Then, the electrorheological fluid (6) was passed from a dropping funnel into a high voltage cell, 16 mm long, 26 mm wide and 1 mm thick, provided with an inlet tube and an outlet tube, each 4 mm in inner diameter, while gradually increasing the applied voltage to determine the voltage at which no more electrorheological fluid (6) passed therethrough at constant 25° C. The electrorheological fluid (6) lost the flowability at 850 V and failed to pass therethrough. In that case, the lower the voltage at which no more fluid can pass therethrough, the better the electrorheological effect. The current at 2 kV was found to be 2.6 μA.

Example 5

Coal pitch (4-I) having a softening point of 305° C., obtained by heat treatment of commercially available coal tar pitch at 400° C. for 6 hours while passing a nitrogen gas therethrough was spun into fibers, 15 μm at 375° C. through the same spinner as used in Example 4, and the resulting fibers were pulverized in a Henschel mixer for 30 minutes, whereby pitch (4-1) having a shape anisotropy was obtained. The thus obtained pitch (4-1) was in a rod-like shape in an aspect ratio of 3 to 40:1.

It was found by elemental analysis that the pitch (4-1) having a shape anisotropy had a carbon content of 95% by weight, a hydrogen content of 4% by weight, and a nitrogen content of 1% by weight. The spin concentration determined by ESR was $5.9\times10^{19}$ spins/g.

Then, an electrorheological fluid (7) was prepared therefrom in the same manner as in Example 4, to determine the electrorheological effect. At 800 V no more fluid passed through the high voltage cell. The current at 2 kV was found to be 2.8 μA.

Example 6

The fibers obtained by spinning in Example 4 were heated in an oxygen gas atmosphere to 320° C. at a temperature elevation rate of 1° C./min. and subjected to heat treatment at 320° C. for one hour to conduct an oxidation treatment, and then pulverized in a Henschel mixer for 30 seconds to obtain pitch (5-1) having a shape anisotropy. The thus obtained pitch (5-1) was in a rod-like shape in an aspect ratio of 3 to 40:1.

It was found by elemental analysis that the pitch (5-1) having a shape anisotropy had a carbon content of 77% by weight, a hydrogen content of 3% by weight and an oxygen content of 20% by weight. The spin concentration determined by ESR was $8.0\times10^{19}$ spins/g. The oxygen concentration on the surface of the carbonaceous substance determined by X-ray microanalysis (EPMA) was 4.7 times that in the interior of the carbonaceous particles.

Then, an electrorheological fluid (8) was prepared therefrom in the same manner as in Example 4 to determine the electrorheological effect. At 550 V, no more fluid passed through the high voltage cell, and the current at 2 kV was found to be 3.2 μA.

Comparative Example 3

Figure 2:
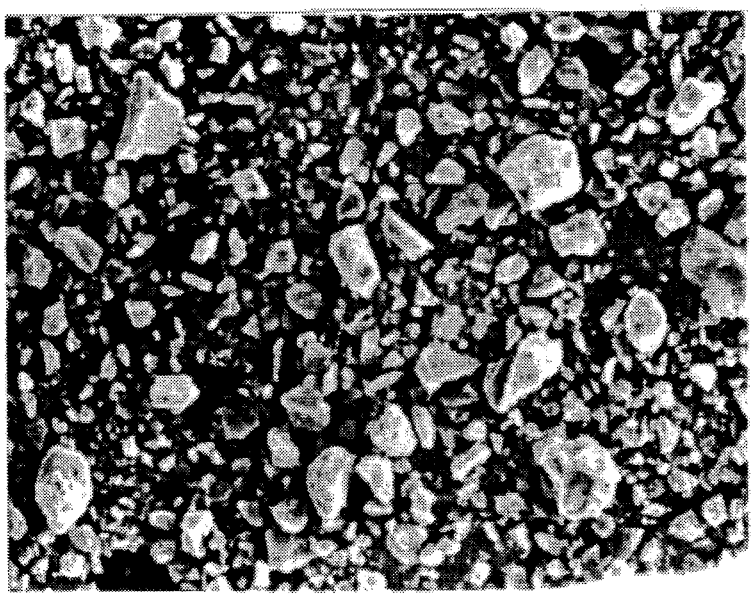
FIG. 2 is an electron microscope picture of carbonaceous particles not spun into a fiber form according to comparative Example 3.

The pitch particles (3-II) obtained in Example 4 were pulverized in a ball mill overnight to obtain spherical or block-like pitch particles (6-1) having an average particle size of 20 μm. Electron microscope picture of the pitch particles (6-1) is shown in FIG. 2.

It was found by elemental analysis that the pitch particles (6-1) had a carbon content of 95% by weight and a hydrogen content of 5% by weight. The spin concentration determined by ESR was $4.0\times10^{19}$ spins/g.

An electrorheological fluid (9) was prepared therefrom in the same manner as in Example 4 to determine the electrorheological effect. At 2.5 kV, no more fluid passed through the high voltage cell, and the current at 2 kV was found to be 2.2 μA.

Comparative Example 4

10 g of silica particles having a particle size of 15 μm were dispersed in 40 g of silicone oil kF-96 (trademark of a product made by Shinetsu Kagaku Co., Ltd., Japan) having a viscosity of 10 cSt, and 1 g of water was added thereto to prepare an electrorheological fluid (10).

Then, the electrorheological effect was determined in the same manner as in Example 4. At 1.5 kV no more fluid passed through the high voltage cell and when the voltage was elevated to 2 kV, a current of 21 μA was passed to cause a short circuit.

From the foregoing, it can be observed that:

(1) As is obvious from the foregoing Examples and Comparative Examples, an electrorheological fluid containing dispersed carbonaceous particles with oxidation-treated surfaces as the dispersible particles of the first aspect of the present invention has a higher electrorheological effect than that containing non-oxidation-treated dispersible carbonaceous particles, and also has a higher electrorheological effect than that containing silica particles and water, and the current passage is less.

(2) The electrorheological fluid according to the first aspect of the present invention has a higher electrorheological effect, less current passage and no occurrence of a short circuit, though it is a water-free system. The electrorheological fluid containing carbonaceous particles with oxidation-treated surfaces as dispersible particles of the present invention has a higher electrorheological effect than that containing heat-treated, but non-oxidation-treated dispersible carbonaceous particles.

(3) As is obvious from the foregoing Examples and Comparative Examples, an electrorheological fluid containing a carbonaceous particles having a shape anisotropy according to the second aspect of the present invention has a higher electrorheological effect than that containing spherical or block-shaped carbonaceous particles, and particularly an electrorheological fluid containing oxidation-treated, dispersible carbonaceous particles having a shape anisotropy has a much higher electrorheological effect.

The electrorheological effect is higher than that of an electrorheological fluid containing silica particles and water and the current passage is also less.

(4) The electrorheological fluid containing a dispersed carbonaceous particles having a shape anisotropy according to the second aspect of the present invention has a higher electrorheological effect, less current passage and no occurrence of a short circuit, though it is a water-free system. The electrorheological fluid containing a dispersed carbonaceous particles having a shape anisotropy with surface oxidation treatment has a much higher electrorheological effect than that containing a dispersible carbonaceous particles having a shape anisotropy without surface oxidation treatment.

What is claimed is:

1. An electrorheological fluid, which comprises an electrically insulating liquid and oxidation-treated carbonaceous particles dispersed therein, wherein a ratio of the dispersed carbonaceous particles to the electrically insulating liquid is 1 to 60:99 to 40% by weight, the dispersed carbonaceous particles have an oxygen content of 0.3% by weight or more and an oxygen concentration on the surfaces of the particles being at least 1.5 times that in the particle interior.

2. An electrorheological fluid, which comprises an electrically insulating liquid and carbonaceous particles having a shape anisotropy, 0.02 to 10,000 μm in length, 0.01 to 500 μm in diameter 2 to 1,000,000 in aspect ratio, dispersed therein, the dispersed carbonaceous particles being pulverized fibers of oxidation-treated petroleum or coal pitch which have an oxygen content of 0.3% by weight or more and an oxygen concentration on the surfaces of the carbonaceous particles being at least 1.5 times that in the interior of the carbonaceous particles, wherein a ratio of the carbonaceous particles to the electrically insulating liquid is 1 to 60:99 to 40% by weight.

* * * * *